US006234532B1

(12) United States Patent
Kollen

(10) Patent No.: US 6,234,532 B1
(45) Date of Patent: May 22, 2001

(54) LATERAL TOE PICK FOR ICE SKATE BLADE

(76) Inventor: Pieter B. Kollen, 12008 Brookshire Pkwy., Carmel, IN (US) 46033

( * ) Notice: Subject to any disclaimer, the term of this patent is extended or adjusted under 35 U.S.C. 154(b) by 0 days.

(21) Appl. No.: 09/289,337

(22) Filed: Apr. 9, 1999

(51) Int. Cl.[7] ..... A63C 1/30
(52) U.S. Cl. ..... 280/841; 28/11.18; 28/11.12
(58) Field of Search ..... 280/841, 11.18, 280/11.12, 11.17, 811, 825

(56) References Cited

U.S. PATENT DOCUMENTS

| | | | | |
|---|---|---|---|---|
| D. 389,544 | | 1/1998 | Adams . | |
| D. 396,084 | | 7/1998 | Laberge . | |
| 2,216,438 | * | 10/1940 | Hamilton | 280/11.2 |
| 2,355,401 | * | 8/1944 | Sim et al. | 280/11.18 |
| 2,764,417 | * | 9/1956 | Sweet | 280/11.12 |
| 2,917,315 | * | 12/1959 | Mihalik | 280/11.12 |
| 2,920,897 | * | 1/1960 | Jensen | 280/11.12 |
| 3,120,397 | * | 2/1964 | Lepkofker | 280/11.12 |
| 3,123,372 | * | 3/1964 | Johns | 280/11.38 |
| 3,181,879 | * | 5/1965 | Hodges | 280/11.12 |
| 5,570,893 | * | 11/1996 | Swande | 280/11.18 |
| 5,595,392 | | 1/1997 | Casillas . | |
| 5,601,473 | | 2/1997 | Strain . | |
| 5,607,347 | | 3/1997 | Schoen . | |
| 5,641,169 | | 6/1997 | Bekessy . | |
| 5,727,796 | | 3/1998 | Zhang . | |
| 5,735,536 | | 4/1998 | Myers . | |
| 5,779,246 | | 7/1998 | Bengtsson . | |
| 5,791,974 | | 8/1998 | Sakcriska . | |
| 5,826,890 | * | 10/1998 | Swande | 280/11.18 |

* cited by examiner

*Primary Examiner*—J. J. Swann
*Assistant Examiner*—J. Allen Shriver
(74) *Attorney, Agent, or Firm*—Daniel L. Boots; Bingham Summers Welsh & Spilman, LLP

(57) ABSTRACT

A lateral toe pick for an ice skate blade is provided for enhancing the ice-gripping ability of the forward toe end of a skate blade and reducing slippage at the blade-to-ice interface in the interest of generating more lift and acceleration for the skater. The toe pick extends laterally from the skate blade and forwardly toward a first fore end of the skate blade to define another second point of engagement between the skate blade and the ice surface during certain skating maneuvers. In a preferred embodiment, the invention includes a second toe pick extending laterally from the skate blade on the opposite side of the skate blade than the first pick and disposed in a similar arrangement relative the first fore end of the skate blade as the opposing first pick. Such second pick defines a third point of engagement between the skate blade and the ice surface, thereby simply further enhancing the ice-gripping capability of the first fore end of the skate blade.

12 Claims, 8 Drawing Sheets

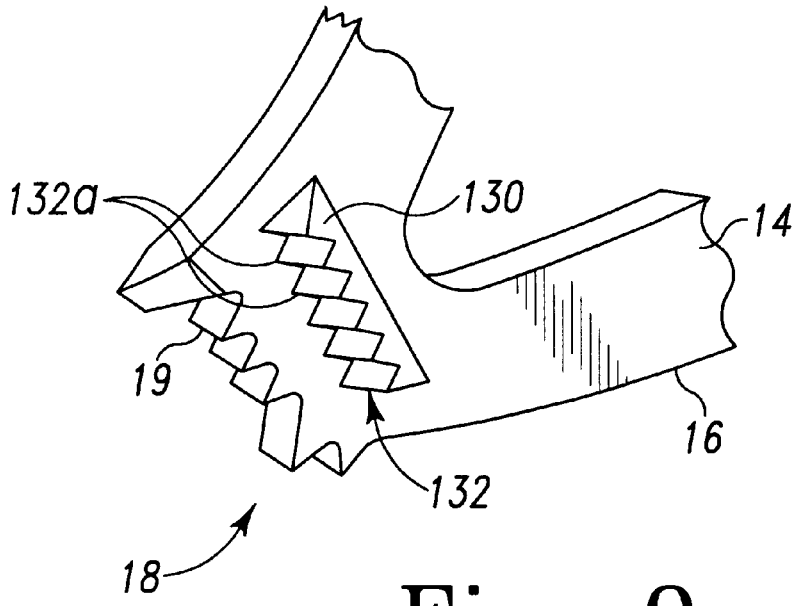
Fig. 9
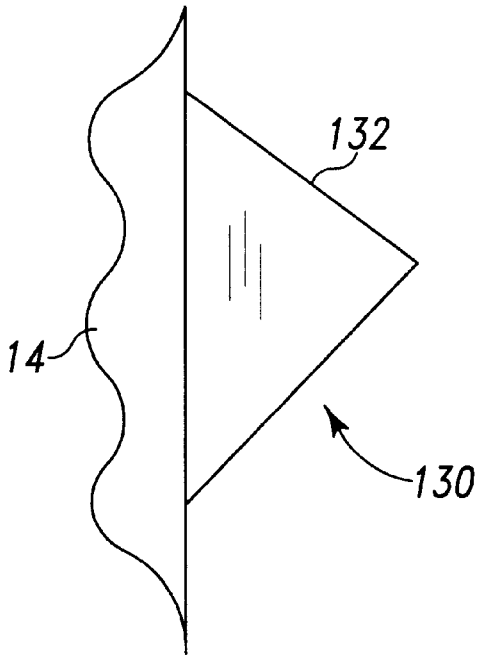
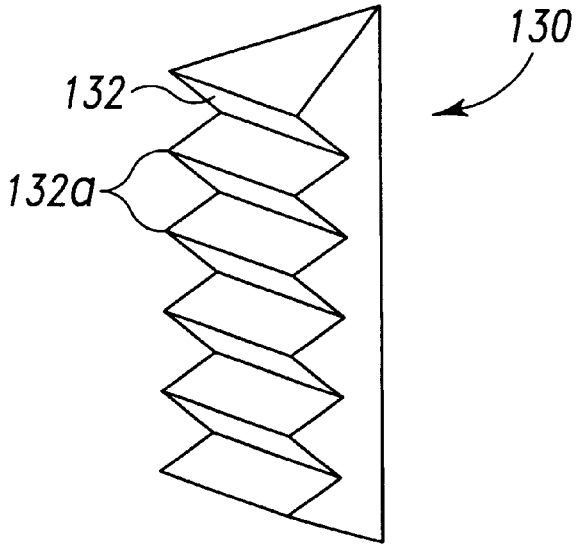
Fig. 11 Fig. 10

LATERAL TOE PICK FOR ICE SKATE BLADE

FIELD OF THE INVENTION

This invention relates to blades for ice skating and, more particularly, to a lateral toe pick device for enhancing the ice-gripping capability of the skate blade.

BACKGROUND OF THE INVENTION

A common problem in competitive figure skating is that in certain maneuvers that require the skater to vigorously plant the forward toe edge of the skate blade into the ice to create lift or take off in order to carry out certain actions while air-borne, typically rotating or spinning, a fair amount of slippage occurs between the forward toe edge of the skate blade and the ice surface at the blade-to-ice interface. Certain of these maneuvers are commonly referred to as the toe loop, the flip and the lutz, of the double, triple and quadruple variety. This slippage robs the skater of lift off power, which concomitantly compromises the skater's ability to fly farther, higher, or longer through the air. Power skating also suffers from slippage at the blade-to-ice interface.

Therefore, a need exists in the art for reducing the slippage that commonly occurs at the blade-to-ice interface and to improve the ice-gripping capabilities of ice skate blades.

SUMMARY OF THE INVENTION

The main objective of the present invention is to provide an ice skate blade with enhanced ice-gripping ability to reduce slippage and the loss of upward lift or acceleration power experienced by an ice skater.

The present invention provides a lateral toe pick intended for assembly onto a skate blade, an ice skate blade having such a lateral toe pick, and a blade-and-boot assembly. The assembly of this invention comprises a boot securable to a skater's foot; an elongated skate blade including a longitudinal lower runner edge for motively engaging an ice surface, a first forward or fore end, a second rear or aft end disposed opposite the first fore end, and upper mounting surfaces for securing the skate blade to the sole plate of the skate boot; and means extending laterally from the skate blade near the first fore end to enhance the ice-gripping ability of the blade. In most blades intended for figure skating, the first fore end includes one or more protruding teeth members, which are commonly referred to as "picks," that collectively define a first point of engagement between the skate blade and the ice surface upon the skater planting the forward toe end of the skate blade into the ice in the performance of various skating maneuvers.

The laterally extending means includes a forward edge extending laterally from the skate blade and slightly forwardly toward the first fore end of the skate blade to define a second point of engagement between the skate blade and the ice during the aforementioned maneuvers. Such means is preferably defined by a toe pick element affixed laterally onto the skate blade or manufactured as an integral part of the skate blade. In a preferred embodiment, the invention includes second means extending laterally from the skate blade on the opposite side of the blade than the first means and disposed in a similar arrangement relative to the first fore end of the skate blade as the first means. Such second means also includes a forward edge extending laterally from the vertical axis of the skate blade and slightly forwardly toward the first fore end of the skate blade to define a third point of engagement between the skate blade and the ice surface, thereby even further enhancing the ice-gripping capability of the first fore end of the skate blade.

These and other advantages and feature which characterize this invention are set forth in the claims presented below. For a complete understanding of the invention, reference should be made to the drawings and the detailed specification below, in which there is described a preferred embodiment of the invention.

BRIEF DESCRIPTION OF THE DRAWINGS

FIG. 9 is an enlarged fragmented perspective view of a second preferred embodiment of the lateral toe pick provided by this invention shown adjacent the forward toe end of a skate blade;

FIG. 10 is a perspective view of the lateral toe pick of FIG. 9 provided by the second preferred embodiment of the invention shown in isolation;

FIG. 11 is an enlarged fragmented top view of the lateral toe pick of FIG. 9;

BEST MODE FOR CARRYING OUT THE INVENTION

Figure 1:
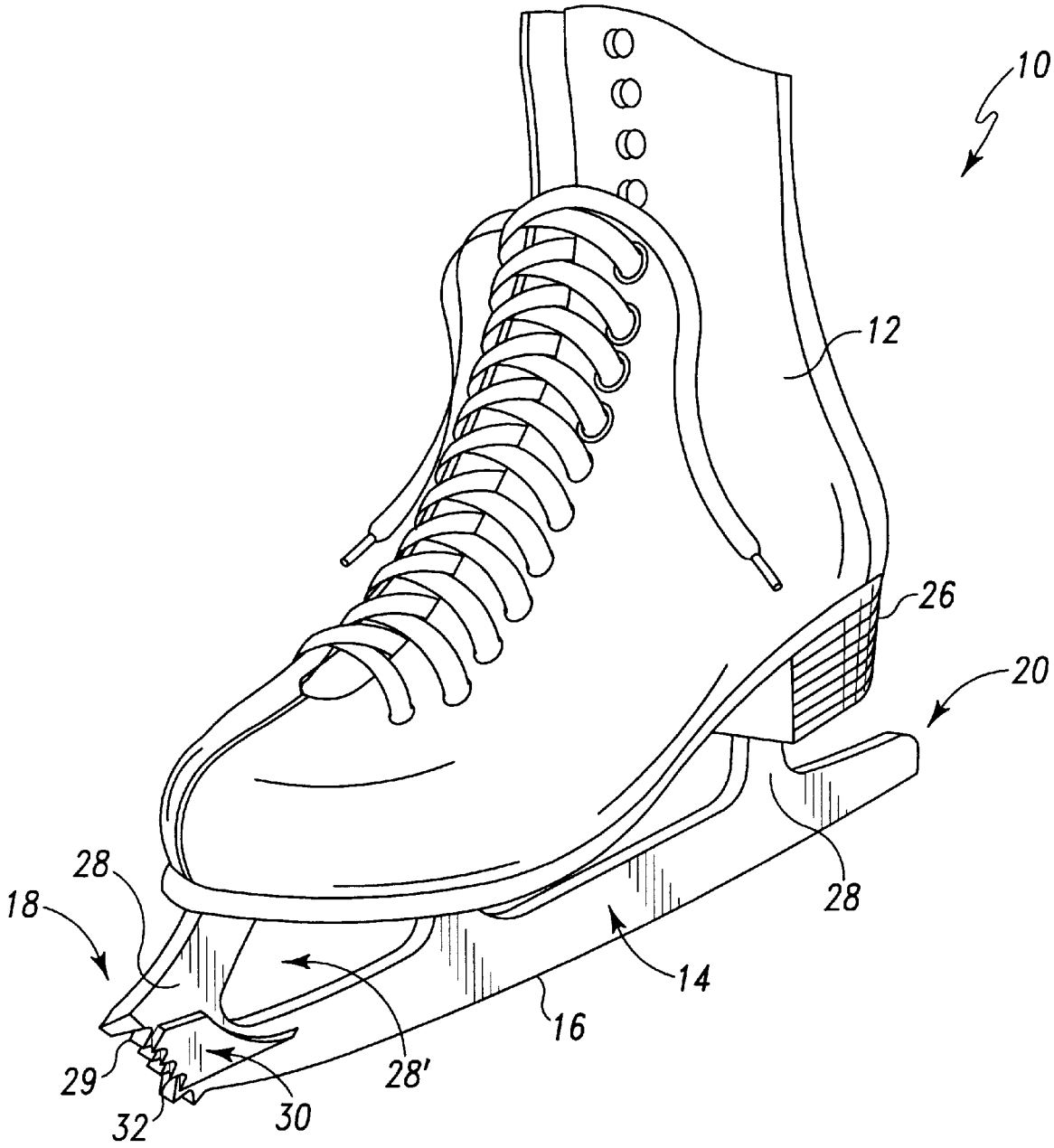
FIG. 1 is a perspective view of the ice skate blade-and-boot assembly presented by a currently preferred embodiment of the invention.

The invention will now be described in more detail in connection with the drawings, wherein like elements are provided with like reference numerals throughout the discussion.

Figure 2:
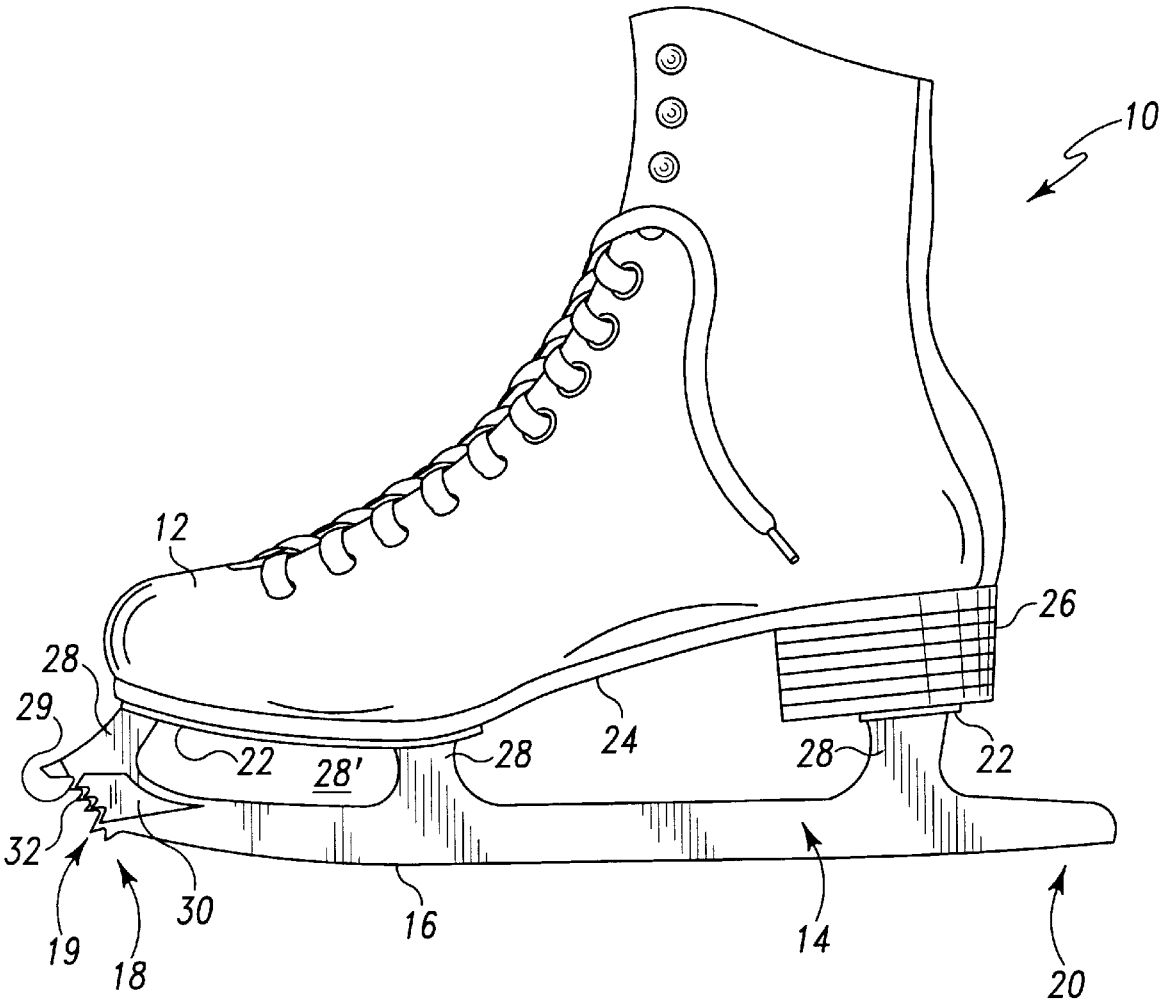
FIG. 2 is a side elevational view of the ice skate blade-and-boot assembly of FIG. 1.
Figure 3:
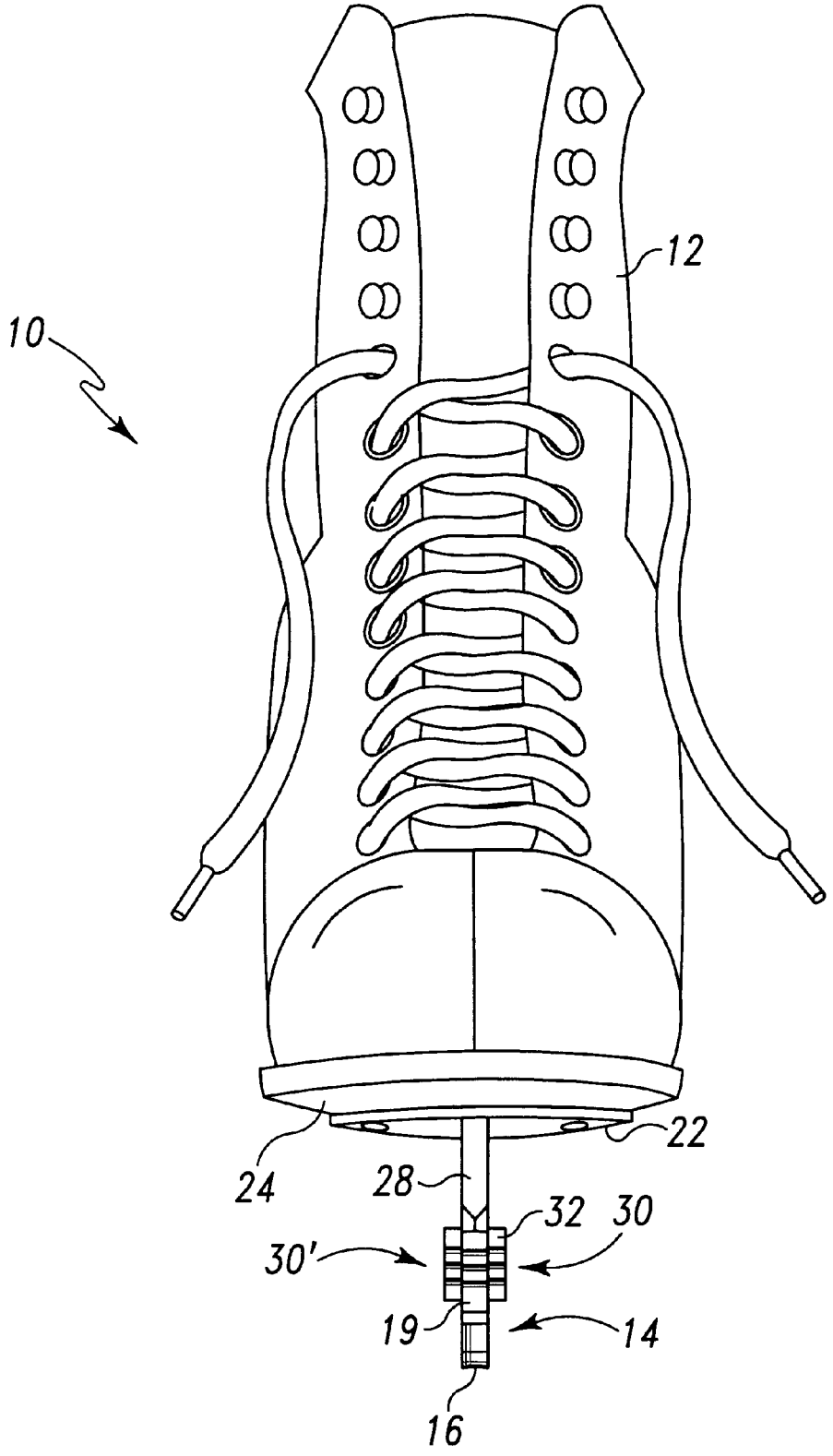
FIG. 3 is a front elevational view of the ice skate blade-and-boot assembly of FIG. 1.
Figure 4:
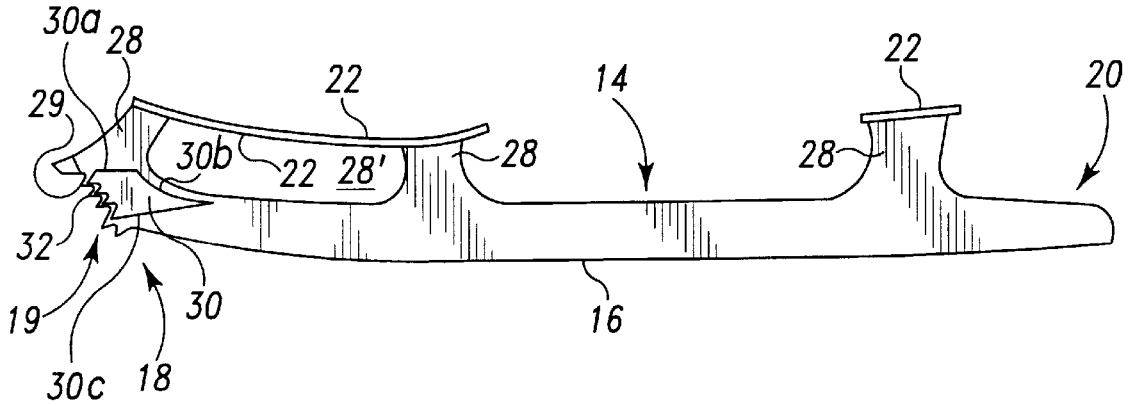
FIG. 4 is a side elevational view of an ice skate blade provided with the lateral toe pick of this invention.
Figure 5:
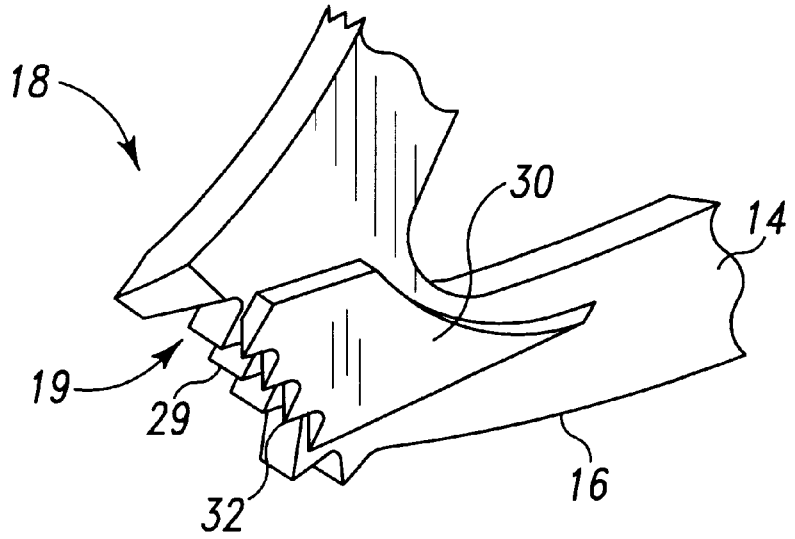
FIG. 5 is an enlarged fragmented perspective view of the forward toe end of the skate blade of FIG. 4 showing the lateral toe pick provided by this invention.

As shown in FIGS. 1–3, the present invention provides a blade-and-boot assembly 10 including a boot 12 securable to a skater's foot; an elongated skate blade 14 including a longitudinal lower runner edge 16 for motively engaging an ice surface, a first forward or fore end 18 with a forwardmost edge 19, a second rear or aft end 20 disposed opposite the first fore end, and upper mounting surfaces 22 for securing the skate blade to the sole plate 24 and heel 26 of the skate boot 12. Extending between the elongated blade portion 14 and the upper mounting plates or braces 22 are a plurality of stanchions 28. In most blades intended for figure skating, the first fore end 18 includes one or more protruding teeth members 29, which are commonly referred to as "picks," that collectively define a first point of engagement between the skate blade and the ice surface upon the skater planting the forward toe end 18 of the skate blade 14 into the ice surface in the performance of the aforementioned skating maneuvers.

The ice skate blade shown in the drawings depicts a blade model made by John Wilson Skates, Sheffield, England, a division of Hattersley & Davidson, Ltd., a United Kingdom company also located in Sheffield, England, purely for illustrative purposes. This model is commercially referred to as the PATTERN 99 Model, which is a very common blade used by many competitive figure skaters in the world today.

A novel aspect of this invention is the provision of means 30 extending laterally from the vertical surface of the skate blade 14 near the first fore end 18. The laterally extending means 30 includes a forward edge 32 extending laterally from the vertical axis of the skate blade and slightly forwardly toward the first fore end 18 of the skate blade to define a second point of engagement between the skate blade and the ice surface during the aforementioned maneuvers. Means 30 is preferably defined by a toe pick element affixed laterally onto the skate blade or manufactured as an integral part of the skate blade.

In a preferred embodiment, the invention includes second means 30' extending laterally from the skate blade on the opposite side of the blade than said first means 30 and disposed in a similar arrangement relative the first fore end 18 of the skate blade as the first means. Second means 30' includes a forward edge 32' extending laterally from the vertical axis of the skate blade and slightly forwardly toward the first fore end 18 of the skate blade to define a third point of engagement between the skate blade and the ice surface during these certain skating maneuvers, thereby enhancing the ice-gripping capability of the first fore end of the skate blade. As with the first toe pick 30, this third point of engagement defined by second toe pick 30' is offset laterally from the first central point of engagement defined by the forward most edge 19 of the fore end 18. Thus, this skate blade invention triples the points of engagement between the ice surface and the fore end 18 of the blade.

While the forward edge 32, 32' of the toe pick 30, 30' is displaced a short distance back from the forwardmost edge 19 of the fore end 18 of the skate blade, such is not necessary for the effective operation of this skate blade invention.

Figure 6:
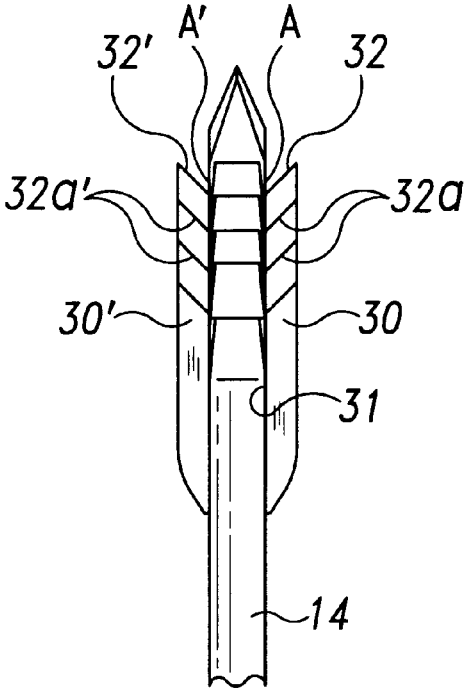
FIG. 6 is an enlarged fragmented bottom view of the forward toe end of the skate blade of FIG. 4 showing the lateral toe pick of this invention.
Figure 7:
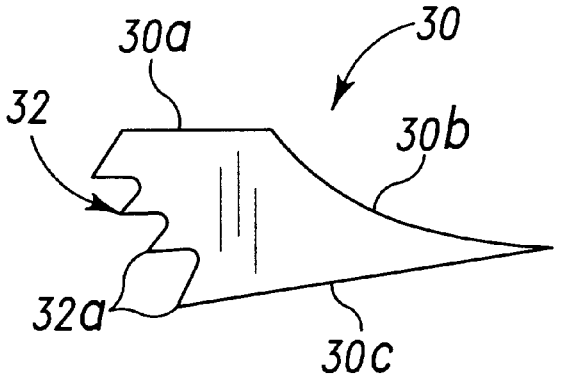
FIG. 7 is a side elevational view of the lateral toe pick provided by this invention shown in isolation.

The lateral toe pick of this invention is shown in isolation in FIG. 7 comprising a toe pick 30 having at least one planar surface 31, which is best shown in FIG. 6 and which in FIG. 7 is the planar surface facing away from the reader (as may be concluded because of the forward edge 32), to abuttingly engage the vertical planar surface of the skate blade in an assembled state. Toe pick 30 can be affixed to the skate blade, if it is not made an integral part thereof, by conventional means such as strong adhesives or welding techniques. In view of the strong forces bearing on the toe pick while in use, it is preferred that the skate blade, which is preferably laser cut from steel sheet material, be forged such that the lateral toe pick is an integral part of the blade itself. Alternatively, the toe pick can be welded onto the planar vertical surface of the fore end 18 of the blade.

The forward edge 32 of toe pick 30 is intended to be disposed in a forward facing arrangement adjacent to the first fore end 18 of the skate blade 14 between the lower runner edge 16 and the upper mounting surface 22. Toe pick 30 further has a top edge 30*a*, an curved rear edge 30*b*, and a lower edge 30*c*. The polygonal configuration of the toe pick is not essential to the invention; however, to ensure that the bond of the toe pick at its abutting interface with the vertical surface of the blade is maintained, it is only logical that the interface area be as large as reasonably possible while not adding excessive weight to the blade. Accordingly, the preferred embodiment of the invention as shown in FIGS. 1–8 has the rear edge 30*b* curving down and away from forward edge 32 to maximize the interface area with the vertical blade surface while allowing for and not interfering with the cutout section 28' of the blade.

It will also be noted that to further enhance the gripping ability of the toe pick 30, 30', it is provided with a series of protruding teeth members 32*a*, 32*a'* in a similar manner in which the forwardmost edge 19 of fore end 18 is provided with a series of protruding teeth members or picks 29. The teeth members 32*a*, 32*a'* extend forwardly from the vertical surface of the blade toward the fore end 18 to define an included angle A, A' therebetween. Angle A, A' is in the range of about 35 to 55 degrees, and is preferably about 45 degrees.

Figure 8:
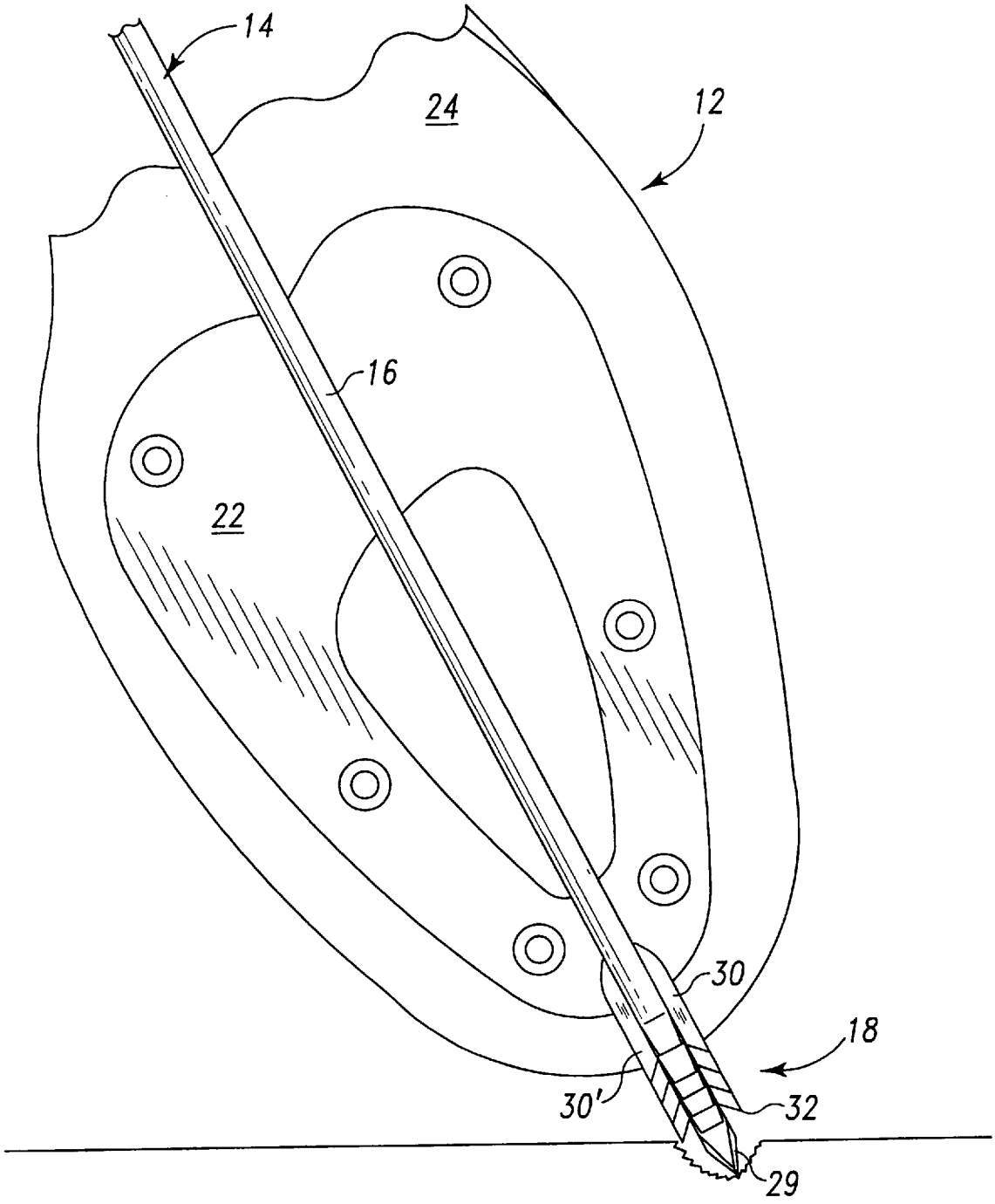
FIG. 8 is an enlarged fragmented view from a perspective of viewing along very near the top of the ice surface at the bottom of the forward toe portion of the ice skate-and-boot assembly of FIGS. 1–3 depicting the phenomenon which occurs at the blade-to-ice interface during one of the aforementioned skating maneuvers.
Figure 12:
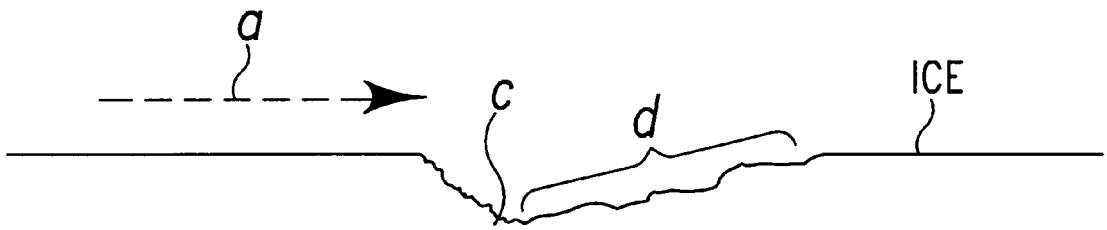
FIG. 12 is a graphical depiction of the print left by a conventional skate blade not equipped with the lateral toe pick of this invention at the point of the skater's take off during one of the aforementioned skating maneuvers.
Figure 13:
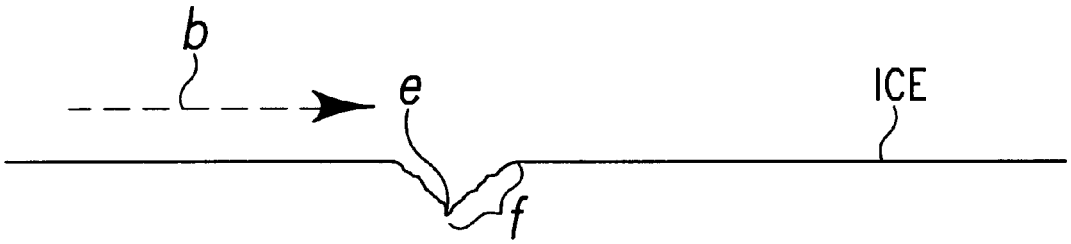
FIG. 13 is a graphical depiction of the print left by a skate blade and lateral toe pick of this invention at the point of the skater's take off during one of the aforementioned skating maneuvers showing the reduced slippage achieved by the invention.

As will be and discussed in relation to FIGS. 8, 12 and 13, the configuration of this invention leaves a much cleaner divot or "print" in the ice surface than a conventional blade due, again, to the enhanced ice-gripping ability of the blade and the reduction of slippage at the blade-to-ice interface. Such a print made by a conventional blade without a lateral toe pick of this invention is shown in FIG. 12, wherein the blade, traveling in the direction of reference arrow "a" and after the forwardmost edge of the blade reaches the lowest point of the divot or print (indicated at "c"), begins to slip along the ice surface indicated along region "d." One will typically observe such long skids in the direction of the skater's take off. Any slippage along the ice surface reduces the vertical force vector or "lift" the skater is generating, thereby compromising the maneuver. In power skating such slippage compromises the skater's ability to accelerate.

FIG. 13 shows the print of a skate blade of the present invention where it is shown that the blade, traveling in the direction of reference arrow "b" and after the forwardmost edge of the blade reaches the lowest point of the divot or print (indicated at "e"), the blade does not experience as much slippage along the ice surface as indicate along region "f." The print clearly shows how the toe pick cuts an equal entrance into and an exit path out of the ice surface. This results in more of the skater's power being translated into vertical or horizontal force vectors and creating either more lift or acceleration, respectively. This phenomenon has been confirmed utilizing high-speed photography at the University of Sheffield Sports Science facility, University of Sheffield, Sheffield, England.

A further embodiment of the toe pick of this invention is shown in FIGS. 9–11 wherein the lateral toe pick 130 has a different configuration that the embodiment of FIGS. 1–8, including a triangular cross-profile wherein the forwardmost edge 132 extends laterally relative to the surface of the skate blade 14 and, unlike the previous embodiment, slightly rearwardly away from the forwardmost edge 19 and toward the aft or rear end (not shown) of the blade. Pick 130 is similarly provided with a series of protruding teeth members 132*a* to enhance its ice-gripping ability. Pick 130 can be made or forged as an integral part of the blade or as a separate component and assembled onto the vertical surface of the blade 14 in the same manners as described above in connection with pick 30. The toe picks 30 and 130 of this invention are preferably constructed from stainless steel or a steel alloy very similar to the material from which the skate blade is constructed.

It will thus be appreciated that the preferred embodiment enhances the ice-gripping ability of the fore toe end of the skate blade, thereby reducing the slippage a skater experiences and translating a greater portion of the skater's energy into lifting or accelerating power. Although specific embodiments have been illustrated and described herein, it will be appreciated by those of ordinary skill in the art that any arrangement or structure which is calculated to achieve the same purpose or objectives may be substituted for the specific embodiments shown. This applications is intended to cover any adaptations or variations of the present invention with respect to figure or hockey skate blades, and it is intended that the invention be limited only by the claims and equivalents thereof.

What is claimed is:

1. An ice skate assembly, comprising:

a boot securable to a skater's foot, said boot having an upper portion for extending upwardly for enveloping the foot and ankle of the skater and a lower sole plate for engaging and supporting the sole of the skater's foot;

an elongated skate blade including a generally planar body having a longitudinal lower runner edge for motively engaging an ice surface, a first fore end, a second rear end opposite said first fore end, and an upper mounting surface for securing the skate blade to the exterior surface of the boot sole plate, said first fore end defining a first point of engagement between the skate blade and an ice surface during certain skating maneuvers; and first pick means extending laterally from the planar body of the skate blade adjacent to the first fore end of the skate blade between the lower runner edge and the upper mounting surface, said pick means including a forward edge extending laterally from the planar body of the skate blade and slightly forwardly toward the first fore end of the skate blade to define an included angle between the forward edge and the planar body of the skate blade and a second point of engagement between the skate blade and the ice surface during said certain skating maneuvers.

2. The ice skate assembly as in claim 1 wherein the forward edge of said pick means is displaced a short distance rearwardly from the first fore end of the skate blade toward the second rear end of the skate blade.

3. The ice skate assembly as in claim 1 further comprising second pick means extending laterally from the planar body of the skate blade on the opposite side of the skate blade than said first pick means and adjacent to the first fore end of the skate blade between the lower runner edge and the upper mounting surface, said second pick means including a forward edge extending laterally from the planar body of the skate blade and slightly forwardly toward the first fore end of the skate blade to define a third point of engagement between the skate blade and the ice surface during said certain skating maneuvers, thereby further enhancing the ice-gripping capability of the skate blade.

4. The ice skate assembly as in claim 3 wherein said certain skating maneuvers include a double toe loop, a triple toe loop, a quadruple toe loop, a flip and a lutz.

5. The ice skate assembly as in claim 1 wherein said first pick means is an integral part of the skate blade.

6. The ice skate assembly as in claim 1 wherein said first pick means is, in an unassembled state, a separate element, said first pick means being fixedly secured to the skate blade.

7. The ice skate assembly as in claim 1 wherein said first pick means is defined by a pick-shaped portion having one or more teeth portions protruding forwardly in the direction of the first fore end of said skate blade.

8. An ice skate blade, comprising:

an elongated planar body including a longitudinal lower runner edge for motively engaging an ice surface, a first fore end, a second aft end opposite said first fore end, and an upper mounting surface for securing the skate blade to the exterior surface of a sole plate of a skate boot, said first fore end defining a first central point of engagement between the skate blade and the ice surface during certain skating maneuvers; and first pick means extending laterally from the planar body of the skate blade adjacent to the first fore end of the skate blade between the lower runner edge and the upper mounting surface, said first pick means including a forward edge extending laterally from the planar body of the skate blade and slightly forwardly toward the first fore end of the skate blade to define an included angle between the forward edge and the planar body of the skate blade and a second point of engagement between the skate blade and the ice surface during said certain skating maneuvers, said second point of engagement being offset laterally from said first central point of engagement.

9. The ice skate blade as in claim 8 further comprising second pick means extending laterally from the planar body of the skate blade on the opposite side of the skate blade than said first pick means and adjacent to the first fore end of the skate blade between the lower runner edge and the upper mounting surface, said second pick means including a forward edge extending laterally from the planar body of the skate blade and slightly forwardly toward the first fore end of the skate blade to define an included angle between the forward edge and the planar body of the skate blade and a third point of engagement between the skate blade and the ice surface during said certain skating maneuvers, said third point of engagement being offset laterally from said first central point of engagement thereby enhancing the ice-gripping capability of the first fore end of said skate blade.

10. The ice skate assembly as in claim 9 wherein said certain skating maneuvers include a double toe loop, a triple toe loop, a quadruple toe loop, a flip and a lutz.

11. A toe pick device intended for assembly onto an ice skate blade, said blade having a generally vertically oriented planar body, a longitudinal lower runner edge for engaging an ice surface, a first fore end, a second aft end opposite said first fore end, and an upper mounting surface for securing the skate blade to the exterior surface of a sole plate of a skate boot, said toe pick device comprising:

a body toe pick having at least one planar surface intended to abuttingly engage the planar body of the skate blade in an assembled state, a first edge intended to be disposed in a forward facing arrangement adjacent to the first fore end of the skate blade between the lower runner edge and the upper mounting surface, said forward edge extending laterally from the at least one planar surface of the body of the skate blade and slightly forward toward the first fore end of the skate blade to define a point of engagement between the toe pick body and the ice surface when the wearer engages the ice surface with the first fore end of the skate blade during certain skating maneuvers, whereby the potential for the first fore end of the skate blade to slip along the ice during said certain skating maneuvers is reduced.

12. The ice skate assembly as in claim 11 wherein said certain skating maneuvers includes a double toe loop, a triple toe loop, a quadruple toe loop, a flip and a lutz.

* * * * *